US007051876B2

(12) United States Patent
Grosskopf

(10) Patent No.: US 7,051,876 B2
(45) Date of Patent: May 30, 2006

(54) PILFER-RESISTANT PACKAGING WITH CRISS-CROSS GRAIN PATTERN

(75) Inventor: Glenn A. Grosskopf, Lake Zurich, IL (US)

(73) Assignee: Colbert Packaging Corporation, Lake Forest, IL (US)

( * ) Notice: Subject to any disclaimer, the term of this patent is extended or adjusted under 35 U.S.C. 154(b) by 0 days.

(21) Appl. No.: 10/651,815

(22) Filed: Aug. 28, 2003

(65) Prior Publication Data

US 2004/0040880 A1 Mar. 4, 2004

Related U.S. Application Data

(60) Provisional application No. 60/406,776, filed on Aug. 29, 2002.

(51) Int. Cl.
*B65D 73/00* (2006.01)
*B65D 83/04* (2006.01)

(52) U.S. Cl. ..... 206/462; 206/469; 206/532; 229/940

(58) Field of Classification Search ..... 206/461–471, 206/484–484.2, 532; 229/940; 383/201
See application file for complete search history.

(56) References Cited

U.S. PATENT DOCUMENTS

| | | | | |
|---|---|---|---|---|
| 2,971,638 | A | 2/1961 | Allison et al. | |
| 3,175,752 | A * | 3/1965 | Stabenow | 383/201 |
| 3,322,613 | A | 5/1967 | Rasmussen | |
| 3,402,873 | A * | 9/1968 | Lauterbach, Jr. | 229/940 |
| 3,409,495 | A | 11/1968 | Rasmussen | |
| 3,454,455 | A | 7/1969 | Rasmussen | |
| 3,695,417 | A * | 10/1972 | Stoker, Jr. | 206/469 |
| 4,236,652 | A * | 12/1980 | Beguhn | 206/484 |
| 4,485,920 | A | 12/1984 | Skylvik | |
| 4,664,262 | A | 5/1987 | White | |
| 4,706,815 | A | 11/1987 | Curtis et al. | |
| 4,762,230 | A * | 8/1988 | Croce | 206/469 |
| 4,781,294 | A | 11/1988 | Croce | |
| 5,799,821 | A | 9/1998 | Lambelet, Jr. et al. | |
| 5,830,548 | A | 11/1998 | Andersen et al. | |
| 6,050,415 | A * | 4/2000 | Lind et al. | 206/470 |
| 6,212,791 | B1 | 4/2001 | Thompson et al. | |
| 6,253,920 | B1 | 7/2001 | Kallgren | |
| 6,279,736 | B1 | 8/2001 | Hekal | |
| 6,284,344 | B1 | 9/2001 | Barnes et al. | |
| 6,308,832 | B1 * | 10/2001 | Pirro et al. | 206/469 |
| 6,345,717 | B1 | 2/2002 | Flewitt | |
| 6,394,275 | B1 | 5/2002 | Paliotta et al. | |
| 2002/0050584 | A1 | 5/2002 | Mizushiro et al. | |
| 2003/0148110 | A1 | 8/2003 | Holbert et al. | |

* cited by examiner (Continued)

*Primary Examiner*—Bryon P. Gehman
(74) *Attorney, Agent, or Firm*—Patzik, Frank & Samotny Ltd.

(57) ABSTRACT

A clamshell package for displaying and housing products or other objects that is substantially pilfer-resistant, yet safe to open. The clamshell packaging includes a substantially tear-resistant housing that encloses a display chamber by criss-cross grain material to provide cut or tear resistance in multiple directions. The display chamber of the clamshell package may be either substantially transparent to allow for the product to be displayed or substantially opaque display graphics and/or to prevent the contents from being viewed. The chamber is preferably seamless such that it may not be opened without the use of scissors and, when opened, such opening is readily apparent. Furthermore, when cut open, the material used does not form sharp or jagged edges that may pose a danger to anyone handling the package. In addition to clamshell packages, the tear resistant material may also be used in blister packs and other types of packaging.

20 Claims, 3 Drawing Sheets

PILFER-RESISTANT PACKAGING WITH CRISS-CROSS GRAIN PATTERN

This application claims priority to U.S. Provisional Patent Application Ser. No. 60/406,779, filed on Aug. 29, 2002 and PCT Application Ser. No. PCT/US 2002/31224, filed on Oct. 1, 2002.

FIELD OF THE INVENTION

This invention relates in general to packaging, and more particularly to packaging that inhibits pilfering, and still more particularly to packaging that is constructed of a substantially tear-proof card material.

BACKGROUND OF THE INVENTION

Heretofore, it has been well known to use clamshell packaging for labeling and housing various products. Clamshells are generally comprised of a housing and a chamber for storing products and may be reusable or permanently sealed. Permanently sealed clamshells are generally formed from a clear plastic housing that is sealed together through radio frequency (RF), sonic vibrations or electrical resistance. As the housing is generally made from clear plastic, inserts made of cardboard and other materials are often inserted into the clamshell packaging to describe or label the goods.

While permanently sealed clamshells offer increased protection from pilfering, there are several drawbacks associated with the use of such clamshells. In particular, the processes for inserting an insert and for sealing the clamshell together are generally expensive and time consuming. Moreover, in order to hold the larger quantities of products in the "institutional" or "value" packages normally sold in warehouse clubs and the like, and/or to make such packages harder to shoplift, such large all-plastic clamshells tend to take up a greater amount of shelf space than necessary, use up more packaging material than necessary to make the package, and result in a greater amount of wasted packaging material. Such sealed all-plastic clamshells also tend to be harder to open by the consumer (after purchase) than other sorts of packaging. Additionally, such plastic packaging is typically slippery, whereby a knife or scissors being used to open the package by penetrating the plastic clamshell can bounce or slip off the package and cut or otherwise wound the user. Furthermore, when cut open, the plastic housing often has sharp edges that can pose a risk to the user and/or young children.

Another common type of container incorporates an opaque box to store goods or products so that they are not visible to the consumers or others. Such boxes are typically made from a cardboard or heavy stock paper having sides comprised of flaps. In order to seal the boxes, the flaps of the box are adhered to one another. The box is, therefore, opened by pulling one flap apart from the other flaps of the box. While these boxes may, in many respects, work, problems have arisen with respect to their use. In particular, because of the way that the boxes are opened and closed, the edges of the flaps are not perfectly flush with the box. Accordingly, the edges may be torn and/or inadvertently opened if the packaging is contacted against a sharp surface or other object. Having opened or partially opened boxes may result in additional costs and expenses to the storeowner or seller because consumers are less likely to buy goods that appear to have been tampered with or damaged. Additionally, because these boxes may be readily opened by opening a flap along their exposed seams, the products are susceptible to pilfering and such pilfering is not always immediately detectable. The potential problem with pilfering of products, such as razorblades, has forced many stores to remove the products from the general store shelves and instead place such products behind the counters. Accordingly, both the customers and employees are inconvenienced by the fact that the products must be specifically requested by the customers and retrieved by an employee in order to purchase them.

Therefore, there is a need to produce a substantially pilfer-proof blister pack or other packaging container that allows for a retailer to describe or label the product, while being economical, easy to manufacture and sized to take up a minimum amount of shelf space.

SUMMARY OF THE INVENTION

The present invention is an improvement over the prior product packaging in that layers of the card material for the housing are overlapped so as to criss-cross the grain of the overlapped layers used. Accordingly, the housing is resistant to tearing in two directions instead of only one. The housing is preferably printable to allow for advertising, promotional or other information to be displayed and includes one or more holes to accommodate one or more chambers for storing the product. Each of the chambers preferably has a rim that extends around the bottom of the chamber so that when the chamber is inserted through the opening in the housing, the rim abuts with the underside of the top layer or sheet or the housing to prevent the chamber from being pulled through the opening.

The product display chamber may be, among other things, substantially transparent or substantially opaque. In the case of the substantially transparent chamber, the chamber may be, among other things, a single large plastic compartment or multiple bubble-like plastic compartments, and is preferably secured within the housing by the overlapping layers of the card portion. Thus, once in place, the products are securely contained within and visible through the chamber.

The embodiment having the substantially opaque chamber is preferably made from a substantially tear-resistant material. In order to further protect against theft, the chamber is preferably substantially seamless with reinforced corners. Such seams or exposed tape present on conventional packaging (which make them prone to pilferage) can thus be avoided. A security device such as a sensor may also be placed within the product packaging to inhibit anyone from stealing the whole package.

It is therefore an object of the present invention to provide a new packaging container wherein the housing is manufactured from a printable, substantially tear-resistant material.

Another object of the present invention is to provide a packaging container for displaying products or product information that is substantially tear-resistant.

Yet another object of the present invention is to provide a packaging container that inhibits theft and the inadvertent opening of the packaging.

A further object of the present invention is to provide a packaging container that is easy and economical to manufacture.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
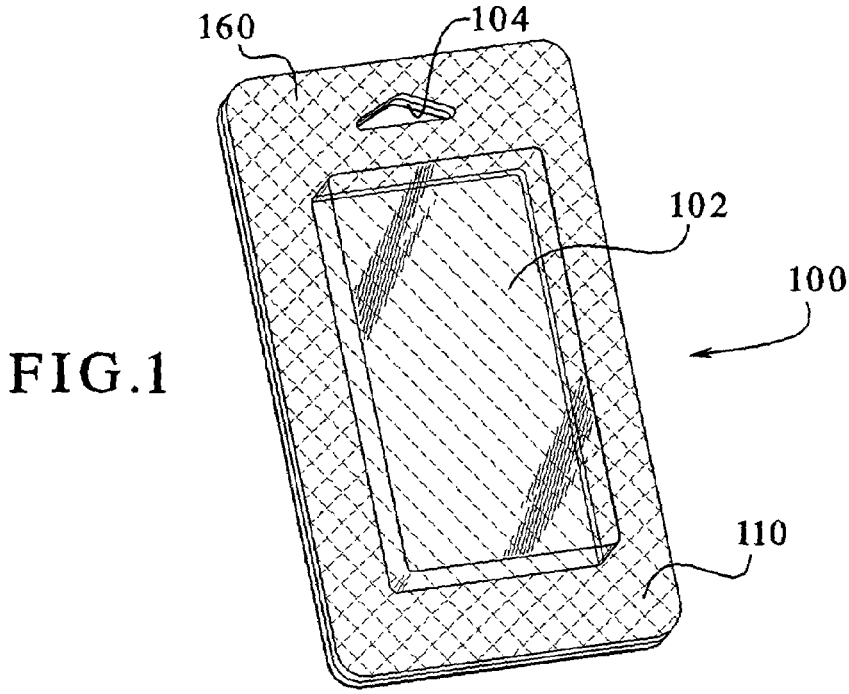
FIG. 1 is a perspective view of an embodiment of a clamshell package having a central, single rectangular display chamber.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 2:
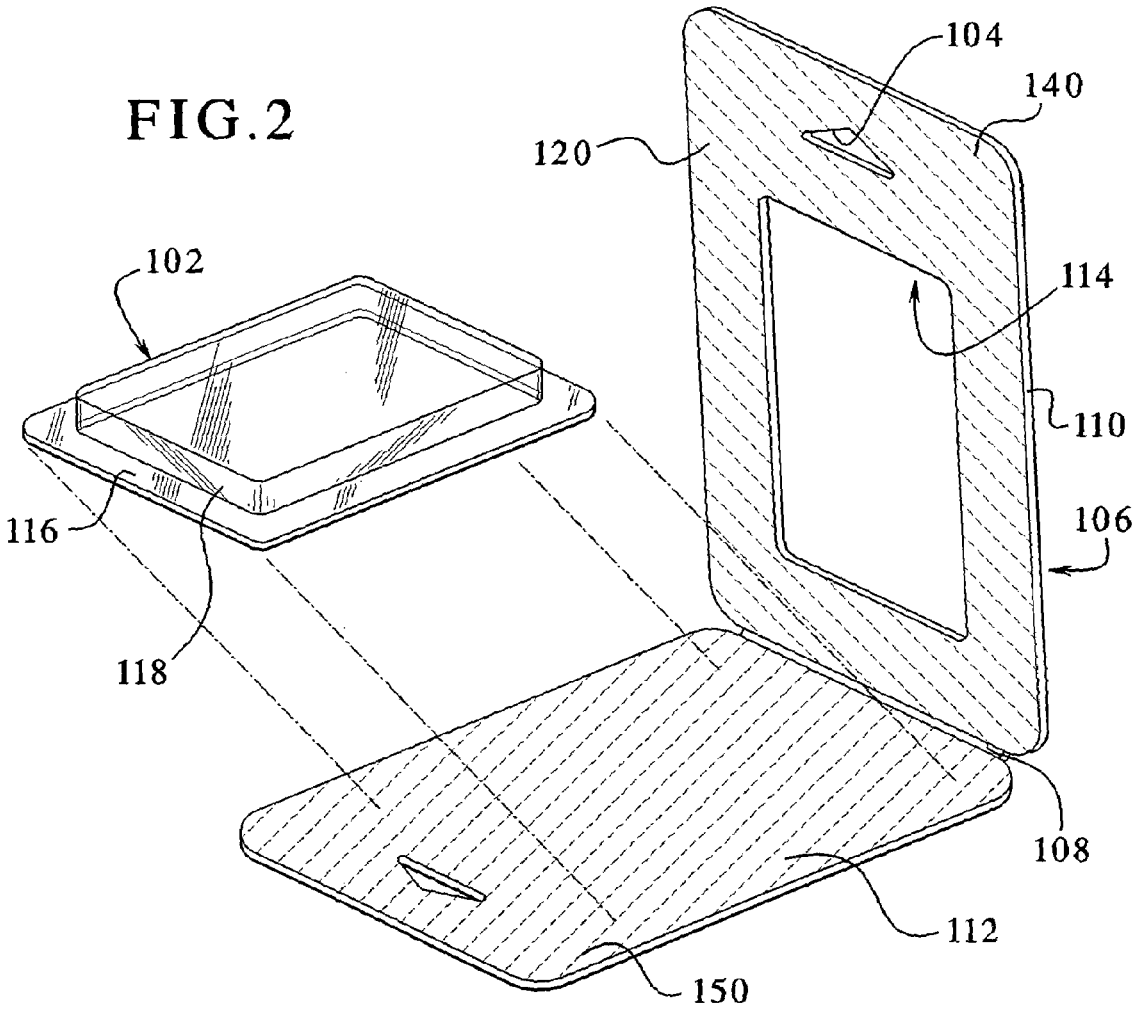
FIG. 2 is an exploded view of the clamshell package from FIG. 1 showing the housing bottom sheet rotated away from the housing top sheet and the central, single rectangular display chamber having a rim to be securely retained between the top and bottom sheets when attached.

Referring now to the drawings, and particularly to FIGS. 1 and 2, the improved product packaging of the present invention, generally designated by the numeral 100, is shown having a housing 106 and a display chamber 102. While a clamshell embodiment having a box-shaped chamber is shown and disclosed, it is appreciated that the present invention may be used with any number of chambers of any known size and shape and with any number of different types of packaging for products and not depart from the scope of the invention.

The housing is preferably made from a SPS board coated on one side with a uni-directional laminated material so that when two housing sheets having grains 140 and 150 are placed on top of one another such that the grains overlap, the crisscrossing grains 160 of the materials adds strength to the housing and protects against tearing or tampering in two directions. A suitable coating is manufactured under the trademark VALERON™ by Valeron Strength Films. While Valeron is made from a polyethylene material, other such coatings such as, but not limited to, polypropylene or polyester may be used. The material used also is preferably printable to allow for advertising, promotional or other information to be displayed on the housing. While a SPS board with a cross-laminated coating is preferred, it is appreciated that other materials having sufficient strength to resist tearing including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF.

As shown in FIG. 2, the housing 106 is preferably made from a single sheet of material having a scored line 108 to facilitate the folding of the top half 110 onto the bottom half 112 of the sheet to form the blister pack 100. While the housing is shown as being formed from a single sheet, it is appreciated that it may be formed from two or more sheets that are then laminated, affixed or otherwise secured or placed together. The top sheet 110 of the housing of the blister pack includes an opening 114 sized to accommodate a display chamber 102 for displaying products or other materials such as labels (not shown) or the like. The opening may be of any shape or size to accommodate a suitable display chamber. Furthermore, it is appreciated that the housing may have any number of openings to accommodate a number of chambers and not depart from the scope of the present invention.

The display chamber 102 preferably extends outward from the housing sheet in order to house the product or label and is preferably made of a substantially transparent material such as a PVC to enable the contents inside the display chamber to be viewed, but may be made of other known materials and not depart from the scope of the present invention. To prevent objects from tampering with or damaging the blister pack, it is preferred that the display chamber be sized to fit snuggly within the opening so that the tamper-resistant sheet of the housing substantially surrounds the perimeter of the open end of the display chamber. In order to secure the display chamber within the housing, a rim 116 may extend around the bottom or open end 118 of the display chamber 102 such that when the display chamber 102 is inserted through the opening 114, the rim 116 abuts with the underside 120 of the top half 110 of the sheet to prevent the display chamber 102 from being pulled through the opening 114. While a contiguous rim is shown in the figures, it is appreciated that the display chamber may be retained by a non-contiguous rim, a series of tabs or other suitable means such as adhesives and/or staples and the like.

With the display chamber inserted into the opening, a product or label may be placed within the display chamber in the proper orientation for display. The two housing halves or portions are then closed together about the scored line and securely affixed. The two halves are preferably affixed together using a heat-sealed adhesive, although it is appreciated that other types of adhesives or attaching means may be utilized and not depart from the scope of the present invention.

The packaging 100 may also include a hole or slot 104 at the upper end of the packaging or elsewhere that is sized to enable the packaging to be placed onto a rod or peg board (not shown) at the point of sale for sale or display. Because of the cross sectional characteristics of the housing, the hole is reinforced to prevent tearing or manipulation.

While the embodiment of the housing of the product packaging is shown and disclosed as having a display chamber that is transparent or substantially transparent, it is appreciated that the chamber may be made of a material or coated with a material that is opaque or substantially opaque, whereby the items contained within the chamber would be substantially hidden. This opaque display chamber would be well suited for a product that is either small, unattractive or otherwise unsuitable for display. Attractive graphics and/or product information could thus be used on the display chamber as well.

Figure 3:
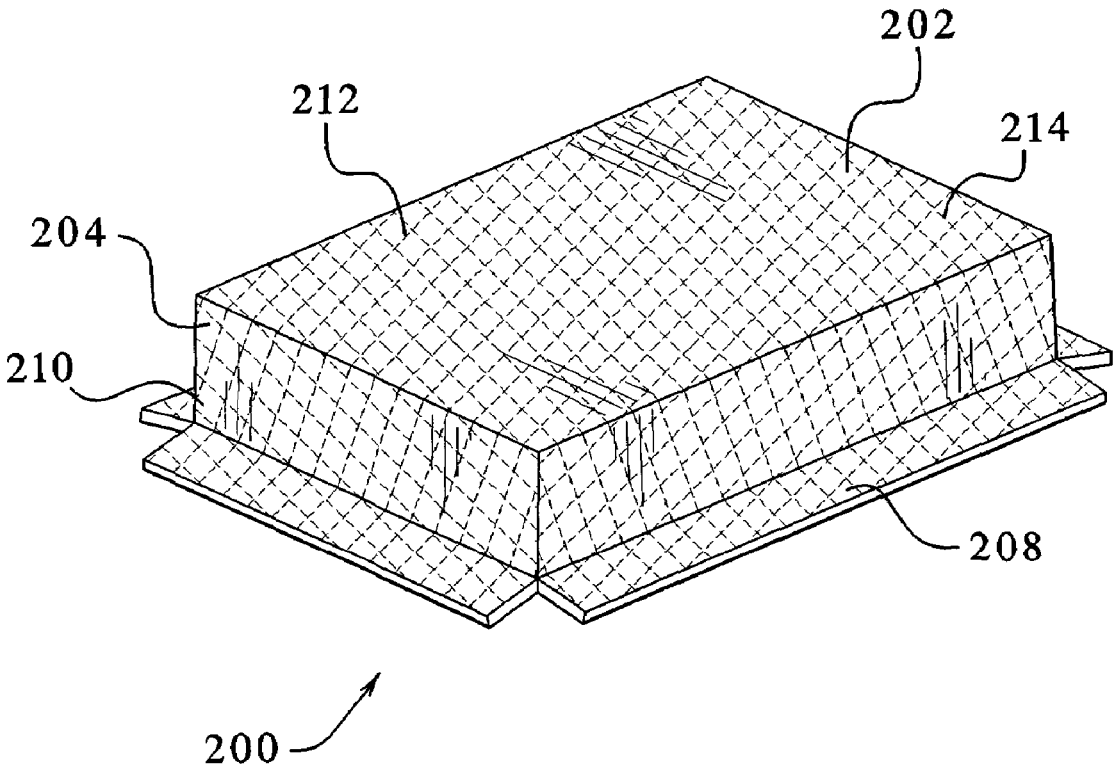
FIG. 3 is a perspective view of a substantially opaque chamber for a clamshell package.

An example of an opaque chamber is shown in FIG. 3. In the preferred embodiment, the chamber 200 may be used with a housing of the kind shown in FIGS. 1 and 2. While the chamber is preferably substantially box-shaped with a top 202 and four walls 204, it is appreciated that the chamber may be of any known shape and size and not depart from the scope of the present invention. It is further appreciated that the chamber may be sized and shaped to facilitate the stacking of multiple yet to be used chambers during the manufacturing process. For example, it is appreciated that angles may be incorporated into the walls 204 of the chamber 200 or other features incorporated therein, to permit multiple chambers to be nested.

While the material for the chamber may be made from a wide variety of materials, it is preferred that the material be of the type known to protect against tearing or tampering. An example of such a material is a SPS board coated on both sides with a uni-directional material such as VALERON™ such that the grains crisscross to add strength to the chamber. It is also appreciated that the chamber may comprise two layers of SPS board that are coated with a uni-directional laminated material so that when the two layers are placed on top of one another such that the grains 212, 214 overlap, the criss-cross grains of the material add strength to the chamber and protect against tearing or tampering in two directions.

While Valeron is made from a polyethylene material, other such coatings may include, but are not limited to, polypropylene or polyester. The material used also is preferably printable to allow for advertising, promotional or other information to be displayed on the housing. While a SPS board with a cross-laminated coating is preferred, it is appreciated that other materials having sufficient strength to resist tearing, including, but not limited to, cloth films, plastic and cloth films, heat sealable boards and other coatings, also may be used and not depart from the scope of the present invention. Examples of cloth films and cloth and plastic films include those films sold under the names SCRIMM and CLAFF. The chamber thereby acts to prevent consumers from seeing the product, as well as preventing undesired removal of the product from the package prior to purchase.

In order to further assist in the prevention of theft of the blister pack and its contents, the interconnection between the walls of the chamber are preferably substantially seamless. Accordingly, unlike the known product packages, the walls will not tend to separate or be easily separated by the consumer to facilitate the unwanted opening of the chamber before purchase of the product. Additionally, the corners and/or sides of the chamber are preferably reinforced to further prevent any tampering of the chamber. Examples of chambers having reinforced corners and sides include, but are not limited to, chambers having their edges reinforced with fiber-reinforced tape or a fiber laminate, similar to a set-up box.

It is further appreciated that the chamber may also contain a security device such as, but not limited to, a product sensor/transmitter that will set off an alarm to indicate that a consumer or customer may be passing a security sensor and thereby leaving the store with an unpurchased product.

To prevent objects from being inserted to tamper with or damage the blister pack, it is preferred that the chamber 200 be sized to fit snuggly within the opening 114 so that the tamper-resistant sheet of the housing 110, 112 surrounds substantially the perimeter of the chamber 200. In order to secure the chamber 200 within the housing 110, 112, a lip or rim 208 may extend from one or more of the bottoms 210 of the walls 204 of the chamber 200 such that when the chamber is inserted through the opening 114, the lip 208 abuts with the underside 120 of the top half 110 of the sheet to prevent the chamber 200 from being pulled through the opening 114. While separate lips are shown, it is appreciated that the chamber may be retained by a contiguous lip, a series of tabs, or any other suitable means such as adhesives and/or staples and the like.

In order to gain access to the product or information contained within the display chamber, it is understood that the housing may be cut with scissors or a knife. Because of the material used for the housing, the resulting cut surfaces will be substantially free of sharp edges, thereby making the product package safer to use.

Figure 4:
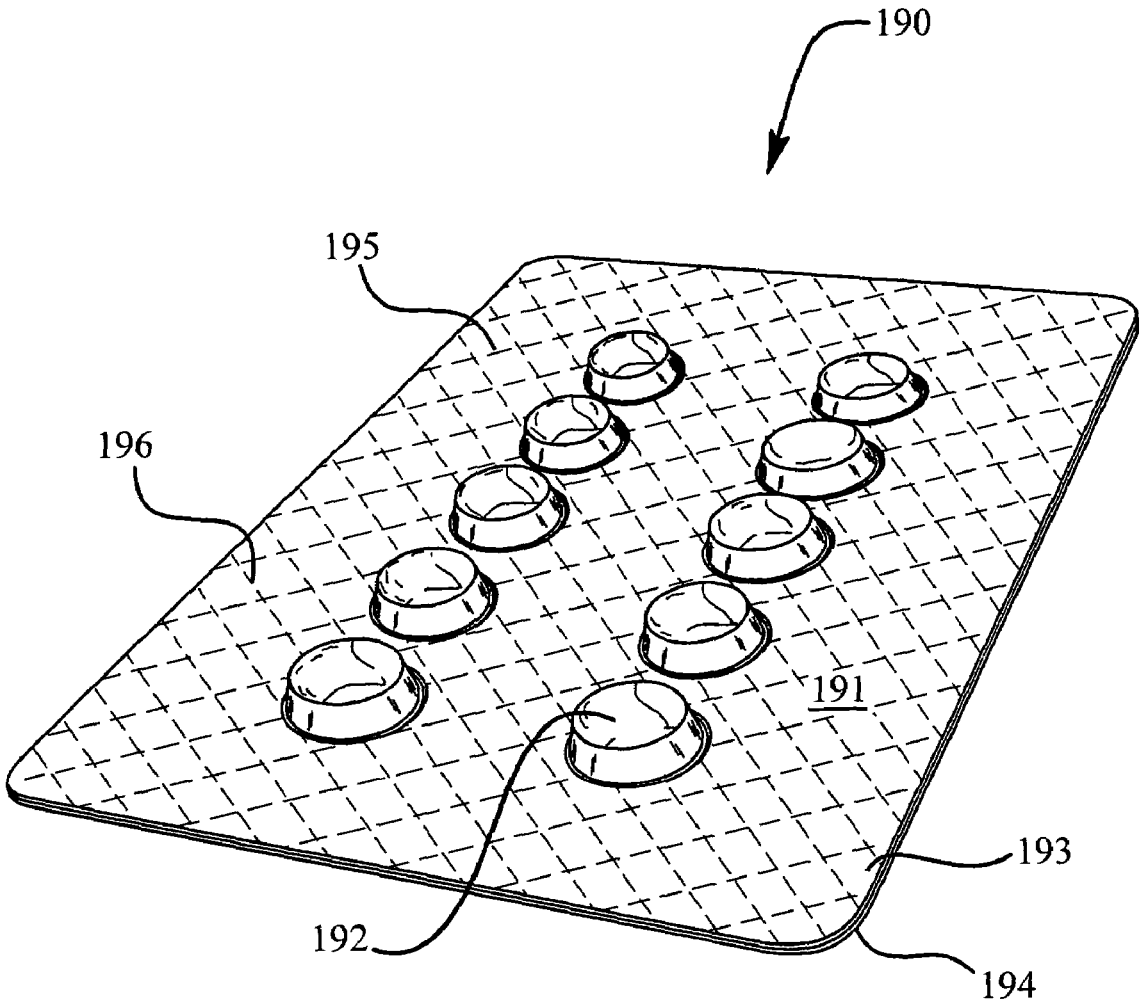
FIG. 4 is a perspective view of an embodiment of a blister pack providing criss-cross grain card material surrounding a plurality of blisters.

Turning to FIG. 4, an embodiment of a pill dispensing blister pack 190 is shown having a housing 191 and a plurality of blisters 192. The housing is preferably a criss-cross grain double layer card 191 that includes a top sheet 193 and a bottom sheet 194 that surround and retain a plurality of blisters 192. In the preferred embodiment, the housing is made from a SPS board coated on one side with a uni-directional laminated material so that when two housing sheets having grains 195 and 196 that extend in different directions are placed on top of one another such that the grains overlap, the criss-crossing grains of the materials add strength to the housing and protect against tearing or tampering in two directions. A suitable coating is manufactured under the trademark VALERON™ by Valeron Strength Films. While Valeron is made from a polyethylene material, other such coatings such as, but not limited to, polypropylene or polyester may be used. The material used also is preferably printable to allow for advertising, promotional or other information to be displayed on the housing. While a SPS board with a cross-laminated coating is preferred, it is appreciated that other materials having sufficient strength to resist tearing, including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF.

Similar to the clamshell packaging in FIGS. 1 to 3, the blisters preferably include a rim about their bottom that interacts with the housing sheets to secure the blister in place. While the blister pack is shown as having ten substantially round blisters, it is appreciated that the blister pack may have any number of blisters of varying shapes and not depart from the scope of the present invention. A plurality of dispensing slots are formed on the bottom of the card 191 and are covered with film or foil so that the pills contained in blisters 192 can be pushed through a thin film or foil sheet.

It will be understood that modifications and variations may be effected without departing from the scope of the novel concepts of the present invention, but it is understood that this application is limited only by the scope of the appended claims.

The invention claimed is:

1. A clamshell package comprising:

a housing comprising:

a first portion made from a substantially tear-resistant material having a grain aligned in substantially one direction;

a second portion attached to the first portion and made from a substantially tear-resistant material having a grain aligned in a direction relative to said grain of said first portion so as to result in a criss-cross pattern of grain when said first and second portions are placed together so as to provide resistance to tearing in multiple directions; and an opening in the first portion of the housing; and a display chamber substantially surrounded by and extending through said opening of the first portion of the housing and secured within the housing.

2. The clamshell package of claim 1 wherein the second portion is fixedly attached to the first portion.

3. The clamshell package of claim 1 wherein the first and second portion are made from a printable material.

4. The clamshell package of claim 1 wherein the display chamber includes a rim that abuts against a side of the first portion of the housing when the display chamber extends through the housing to retain the display chamber within the housing.

5. The clamshell package of claim 1 wherein the substantially tear-resistant material is a SPS board coated with a polyethylene material.

6. The clamshell package of claim 1 wherein the display chamber is made from a material that is substantially transparent.

7. The clamshell package of claim 1 wherein the display chamber is made from a material that is substantially opaque.

8. The clamshell package of claim 7 wherein the display chamber is made from a substantially tear-resistant material.

9. The clamshell package of claim 8 wherein the substantially tear-resistant material is a SPS board coated with a polyethylene material.

10. The clamshell package of claim 8 wherein the display chamber is substantially seamless.

11. The clamshell package of claim 8 wherein the display chamber comprises an exterior, and wherein the display chamber includes graphics on the exterior.

12. The clamshell package of claim 1 which further comprises a slot extending through the first and second portions of the housing for use in displaying the clamshell package.

13. A blister pack for dispensing objects comprising:

a blister sheet having one or more blisters, wherein each blister includes a cavity for housing an object; and a housing comprising:

a first portion made from a substantially tear-resistant material, the first portion having a grain aligned in substantially one direction; and a second portion made from a substantially tear-resistant material, the second portion having a grain aligned in a direction relative to the grain of the first portion and attached to the first portion so as to result in a criss-cross pattern of grains to provide resistance to tearing in multiple directions.

wherein the blister sheet is positioned between the first portion and the second portion such that at least part of at least one of the cavities extends outward from the first portion.

14. The blister pack of claim 13 wherein the object is a pill.

15. The blister pack of claim 13 wherein the substantially tear-resistant material comprises a SPS board coated with a polyethylene material.

16. A clamshell package comprising:

a housing comprising:

a first portion made from a substantially tear-resistant and printable material having grain aligned in a first direction;

a second portion attached to the first portion and made from a substantially tear-resistant material having grain aligned in a second direction relative to said grain of said first portion so as to result in a criss-cross pattern of grain when said first and second portions are placed together so as to provide resistance to tearing in multiple directions; and an opening in the first portion of the housing; and a display chamber substantially surrounded by and extending through the opening of the first portion of the housing, wherein the display chamber includes a rim that abuts against the underside of the first portion of the housing when the display chamber is substantially surrounded by said first portion to secure the display chamber with respect to the housing, and wherein the display chamber is substantially seamless.

17. A clamshell package comprising:

a housing comprising:

a first portion made from a SPS board coated with a substantially tear-resistant material having a grain aligned in substantially one direction;

a second portion attached to the first portion and made from a SPS board coated with a substantially tear-resistant material having a grain aligned in a direction relative to said grain of said first portion so as to result in a criss-cross pattern of grain when said first and second portions are placed together so as to provide resistance to tearing in multiple directions; and an opening in the first portion of the housing; and a display chamber substantially surrounded by and extending through said opening of the first portion of the housing and secured within the housing.

18. The clamshell package of claim 17 wherein the substantially tear-resistant material comprises polyethylene.

19. A blister pack for dispensing objects comprising:

a blister sheet having one or more blisters, wherein each blister includes a cavity for housing an object; and a housing comprising:

a first portion made from a SPS board coated with a substantially tear-resistant material having a grain aligned in substantially one direction; and a second portion made from a SPS board coated with a substantially tear-resistant material having a grain aligned in a direction relative to the grain of the first portion and attached to the first portion so as to result in a substantially criss-cross pattern of grains to provide resistance to tearing in multiple directions.

wherein the blister sheet is positioned between the first portion and the second portion such that at least part of the cavity extends outward from the first portion.

20. The blister pack of claim 19 wherein the substantially tear-resistant material comprises polyethylene.

* * * * *

UNITED STATES PATENT AND TRADEMARK OFFICE

CERTIFICATE OF CORRECTION

PATENT NO. : 7,051,876 B2
APPLICATION NO. : 10/651815
DATED : May 30, 2006
INVENTOR(S) : Glenn A. Grosskopf It is certified that error appears in the above-identified patent and that said Letters Patent is hereby corrected as shown below:

On Title Page
Item (54) Replace "PILFER-RESISTANT PACKAGING WITH CRISS-CROSS GRAIN PATTERN" with --PILFER-RESISTANT PACKAGING--

On Title Page
Item (60), replace "60/406,776" with --60/406,779--

On Title Page, Item (57)
Abstract, after "opaque" and before "display" insert --to--

Column 2

Line 31, replace "or" with --of--

Column 3

Line 37, replace "SPS" with --SBS--
Line 49, replace "SPS" with --SBS--

Column 5

Line 4, replace "SPS" with --SBS--
Line 8, replace "SPS" with --SBS--
Line 18, replace "SPS with --SBS--

Column 6

Line 7, replace "SPS" with --SBS--
Line 20, replace "SPS" with --SBS--

Column 7

Line 5, replace "SPS" with --SBS--
Line 16, replace "SPS" with --SBS--
Line 39, replace "." with --,--
Line 47, replace "SPS" with --SBS--

UNITED STATES PATENT AND TRADEMARK OFFICE

CERTIFICATE OF CORRECTION

PATENT NO. : 7,051,876 B2
APPLICATION NO. : 10/651815
DATED : May 30, 2006
INVENTOR(S) : Glenn A. Grosskopf It is certified that error appears in the above-identified patent and that said Letters Patent is hereby corrected as shown below:

Column 8

Line 17, replace "SPS with --SBS--
Line 22, replace "SPS" with --SBS--
Line 39, replace "SPS" with --SBS--
Line 42, replace "SPS' with --SBS--

Signed and Sealed this

Twelfth Day of December, 2006

JON W. DUDAS
*Director of the United States Patent and Trademark Office*